US010126086B2

(12) United States Patent
Smith

(10) Patent No.: US 10,126,086 B2
(45) Date of Patent: Nov. 13, 2018

(54) AMBIDEXTROUS SAFETY FOR A FIREARM

(71) Applicant: Evolution Gun Works, Inc., Quakertown, PA (US)

(72) Inventor: George J. Smith, Upper Black Eddy, PA (US)

(73) Assignee: Evolution Gun Works, Inc., Quakertown, PA (US)

( * ) Notice: Subject to any disclaimer, the term of this patent is extended or adjusted under 35 U.S.C. 154(b) by 268 days.

(21) Appl. No.: 14/926,074

(22) Filed: Oct. 29, 2015

(65) Prior Publication Data

US 2017/0122689 A1 May 4, 2017

(51) Int. Cl.
*F41A 35/06* (2006.01)
*F41C 3/00* (2006.01)
*F41A 17/00* (2006.01)

(52) U.S. Cl.
CPC ..... *F41A 35/06* (2013.01); *F41A 17/00* (2013.01); *F41C 3/00* (2013.01)

(58) Field of Classification Search
CPC ..... F41A 35/06; F41A 17/00; F41C 3/00
USPC ..... 42/70.06
See application file for complete search history.

(56) References Cited

U.S. PATENT DOCUMENTS 1,070,582 A 8/1913 Browning
1,355,423 A * 10/1920 Pedersen ..... F41A 17/38 42/75.01
1,896,820 A * 2/1933 Jolidon ..... F41A 9/53 42/1.01
2,846,925 A * 8/1958 Norman ..... F41A 17/38 42/25
3,492,748 A * 2/1970 Swenson ..... F41A 17/00 42/70.01
4,414,769 A * 11/1983 Mueschke ..... F41A 35/06 42/70.01
4,589,327 A * 5/1986 Smith ..... F41A 17/74 42/70.08
4,590,697 A * 5/1986 Ruger ..... F41A 17/56 42/70.01
4,681,020 A * 7/1987 Polanecky ..... F41A 9/62 89/138
4,726,136 A * 2/1988 Dornaus ..... F41A 9/53 42/7
4,742,634 A * 5/1988 Swenson ..... F41A 17/42 42/70.01
5,088,222 A * 2/1992 Larson ..... F41A 17/56 42/70.04
5,212,327 A * 5/1993 Schuemann ..... F41A 17/32 42/70.01
5,245,776 A * 9/1993 Dornaus ..... F41A 17/72 42/144

(Continued)

*Primary Examiner* — Michelle Clement
(74) *Attorney, Agent, or Firm* — Howson & Howson LLP

(57) ABSTRACT

An ambidextrous safety for a firearm is provided. The ambidextrous safety includes separate first and second opposed and spaced-apart thumb safeties that are interconnected by a shaft extending therebetween. The shaft is formed by a first shaft portion extending from the first thumb safety and a second shaft portion extending from the second thumb safety. The first and second shaft portions are interlocked, for instance, via a tongue-and-groove connection. The shaft extends through a separate sleeve which surrounds and reinforces the tongue-and-groove connection and prevents loosening and disconnection thereof.

16 Claims, 2 Drawing Sheets

(56) References Cited

U.S. PATENT DOCUMENTS

| | | | | | |
|---|---|---|---|---|---|
| 5,303,494 | A * | 4/1994 | Tuma | F41A 17/56 | 42/69.03 |
| 5,903,994 | A * | 5/1999 | Tange | F41A 11/00 | 42/70.01 |
| D415,238 | S * | 10/1999 | Kay | D22/100 | |
| D420,416 | S * | 2/2000 | Kay | D22/100 | |
| 6,389,728 | B1 * | 5/2002 | Lundy | F41A 17/02 | 42/70.01 |
| 6,907,814 | B2 * | 6/2005 | Spinner | F41A 11/00 | 42/70.01 |
| 7,698,845 | B2 * | 4/2010 | Hochstrate | F41A 17/72 | 42/69.01 |
| 8,127,481 | B2 * | 3/2012 | Rozum | F41A 17/00 | 42/70.01 |
| 8,333,028 | B1 * | 12/2012 | Karfiol | F41A 17/56 | 42/70.01 |
| 8,499,482 | B1 * | 8/2013 | Di Trolio | F41A 17/42 | 42/70.01 |
| 8,677,667 | B2 * | 3/2014 | Tatum | F41A 35/06 | 42/70.08 |
| 8,943,866 | B2 * | 2/2015 | Fernandez | F41A 17/38 | 42/49.01 |
| 9,057,574 | B2 | 6/2015 | McClave | | |
| 2012/0023801 | A1 * | 2/2012 | Rozum | F41A 17/00 | 42/70.08 |
| 2013/0152444 | A1 * | 6/2013 | Tatum | F41A 17/56 | 42/70.05 |
| 2014/0259846 | A1 * | 9/2014 | Joubert | F41A 17/56 | 42/70.11 |
| 2017/0176122 | A1 * | 6/2017 | Underwood | F41A 17/00 | |

* cited by examiner

FIG. 1
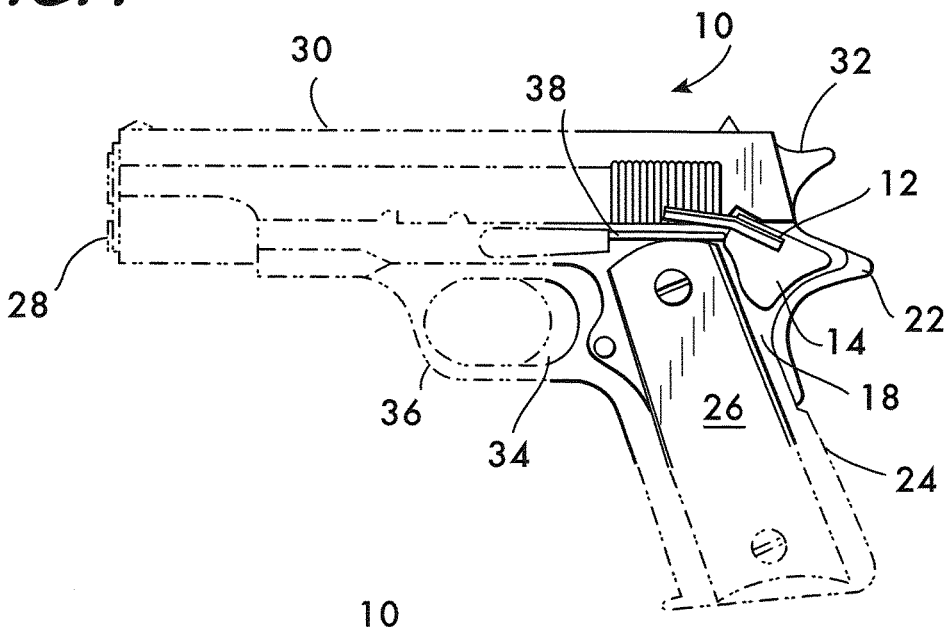
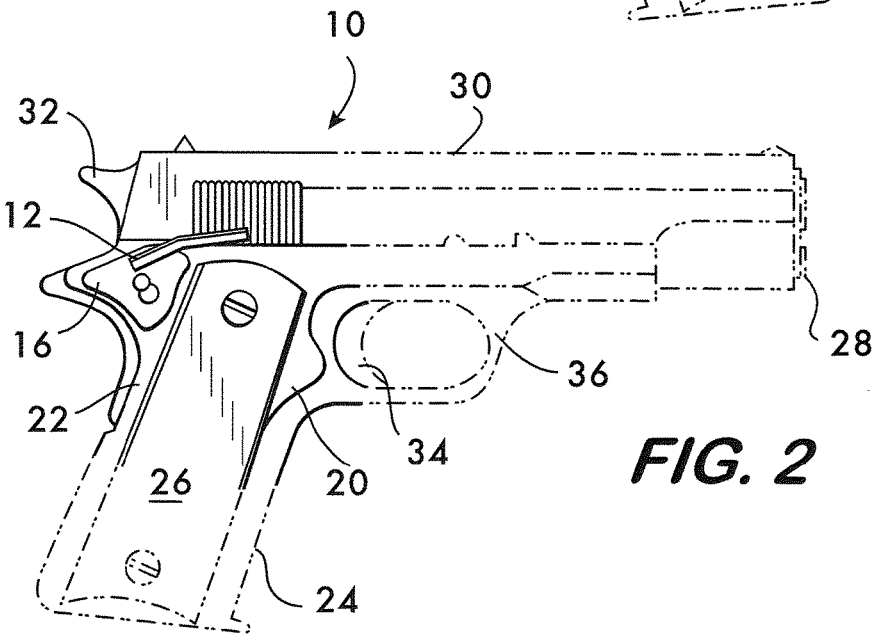
FIG. 2

AMBIDEXTROUS SAFETY FOR A FIREARM

BACKGROUND

The present invention relates to a safety for firearms and more particularly, an ambidextrous safety for pistols.

A safety is a mechanism that can prevent accidental discharge of a firearm. External safeties, such as thumb safeties, permit a user to manually move a lever between a safe position (i.e., on-safe) and a firing position (i.e., off-safe). Typically, such levers are provided on the left side of the firearm such that they provide ready use by a user's right-hand thumb during right-handed use or gripping of the firearm.

To enable left-handed use of a firearm having a safety, an ambidextrous safety can be installed that provides levers on both sides of the firearm. Accordingly, an ambidextrous safety enables right-handed and left-handed use of the firearm and may provide levers for use by either a left or right hand thumb of the user.

Ambidextrous safeties are typically made in two parts that are located on opposite sides of the firearm and are fastened together such that rotation of one about an axis extending lengthwise through a pivot pin of the safety also rotates the other about the same axis. A problem with ambidextrous safeties is that "backlash" or looseness of the two parts can occur. For instance, over time and repeated use, the mechanism used to interconnect the right and left safety levers may be subject to drag which requires additional force to be applied by the user to operate the safety. This tends to cause the right and left side safety elements to become loosened or misaligned thereby preventing the safety from operating in an intended smooth manner or may produce excessive play causing the right-handed safety to walk out or become separated thereby preventing operation of the safety altogether.

BRIEF DESCRIPTION OF THE DRAWINGS

The foregoing and other objects, features and advantages of the embodiments disclosed herein should become apparent from the following description when taken in conjunction with the accompanying drawings.

FIG. 1 is an elevational view of a left side of firearm having an ambidextrous safety in accordance to an embodiment.

FIG. 2 is an elevational view of a right side of the firearm of FIG. 1 in accordance to an embodiment.

DETAILED DESCRIPTION

Figure 3:
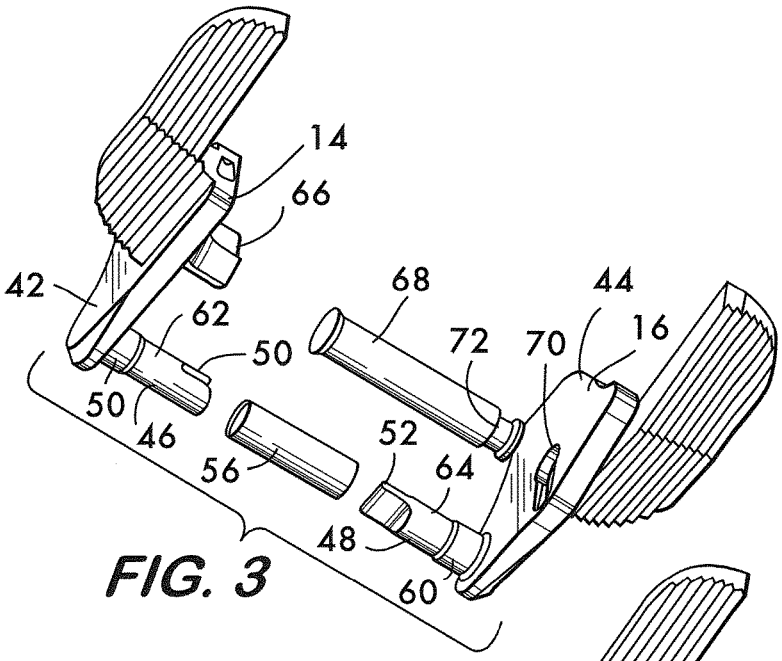
FIG. 3 is an exploded perspective view of the ambidextrous safety apart from the firearm of FIG. 1 in accordance to an embodiment.

A safety on a firearm may be manually activated or deactivated by the shooter. Typically, such a safety is located on the frame of a firearm, such as a pistol, in the proximate area of where the shooter's thumb is positioned when the pistol is properly gripped by the shooting hand of the shooter. Thus, the safety is positioned so as to allow it to be manipulated by the thumb of the shooter without compromising the secure grasp of the pistol allowing it to be held in readiness for immediate use.

By way of example, a firearm 10 as shown in FIGS. 1 and 2 is provided with an ambidextrous safety 12 including an opposed pair of thumb lever safeties, 14 and 16. The pair of levers includes a right-thumb lever safety 14 on the left side 18 of the firearm 10 shown in FIG. 1 for operation by a right-handed shooter and a left-thumb lever safety 16 on the right side 20 of the firearm 10 shown in FIG. 2 for operation by a left-handed shooter.

Each of the thumb lever safeties, 14 and 16, is capable of being pivoted into two different positions by the thumb of the shooting hand of the shooter. The first position may be referred to as the safe, on-safe, or activated position (as shown in FIGS. 1 and 2) which prevents firing of the firearm, and the second position may be referred to as the firing, off-safe, or deactivated position which permits firing of the firearm. In this latter position, the thumb lever safeties would be pivoted in a downward direction relative to the position shown in FIGS. 1 and 2. The ambidextrous safety 12 is held in one of these positions, typically by a spring-loaded mechanical device 38 designed into the pistol, until the shooter manually changes the position of the safety.

By way of example and not by way of limitation, a pistol that may be equipped with a safety is the so-called Government Model of 1911 or the Model 1911 A1 pistol. The M1911 is a single-action, semi-automatic, magazine-fed, recoil-operated pistol chambered for a .45 ACP cartridge. Of course, other pistols and styles of pistols may be equipped with a safety.

Such a pistol may be maintained or stored in several conditions of readiness for use. For instance, the pistol may be in a condition with a loaded magazine, loaded chamber with the hammer at full cock and with the thumb safety in the activated or "on safe" position. When the pistol is in this condition, the pistol operator can grasp the pistol by its grip, push off the thumb safety with the thumb of the shooting hand, and press the trigger when the pistol sights have been aligned on the selected target. When the thumb safety is pressed down into the off position, it may be held there by a detent or the like designed into the thumb safety which, when in this position, is aligned with a spring loaded plunger mounted on the frame of the pistol. The thumb safety is secured in the "off safe" position by this detent and plunger arrangement until pushed, intentionally or inadvertently, into the activated or "on safe" position by the thumb of the shooter.

The Model 1911 pistol may include a thumb safety lever on the left side of the frame for actuating or moving a stud connected to the inward side of the lever and within the pistol into a position which locks cartridge firing components, such as the hammer, the sear, and the trigger in positions against being able to move to cause a discharge of a cartridge within the chamber and the firing of a bullet. The thumb safety lever when moved upward into the "on safe" position may also move into an exposed notch in the breech-slide of the firearm to prevent movement of the breech-slide. See FIG. 1.

Accordingly, the Model 1911 pistol includes safety components so that the shooter can manually move the pivotally mounted thumb lever safety upward into the on-safe position wherein the trigger, the hammer and the breech-slide are secured or locked against causing the discharge of a cartridge (making the pistol non-fireable), and the shooter can, at will, using thumb pressure depress the thumb lever safety downward to move the lever and the attached internal lock stud to a position wherein the sear, trigger and hammer can be actuated to cause the discharge of a cartridge and firing of a bullet, and the breech-slide is unlocked to allow the cycling of the pistol.

With the Model 1911 style pistol, the thumb safety lever will reside in the off safe or downward position (pistol in fireable state) when pushed into such position, and will not return to an on-safe position (pistol in non-fireable state) until manually moved thereto. Accordingly, the Model 1911 pistol provides a relatively safe design of pistol with its features including the trigger/sear lock, hammer lock, and breech-slide lock operatively associated with the thumb safety lever, i.e., engaged and disengaged with movement of the thumb lever safety.

Referring to FIGS. 1 and 2, a pistol may include a frame 22 having a grip or handle portion 24 with grip panels (stocks) 26 on each of two sides thereof. A barrel 28 is typically mounted on the top of the frame 22 and a breech-slide 30 with breech-block is movably connected to the frame 22 for forward and rearward movement relative to the frame 22. A chamber portion (not shown) of the barrel 28 may hold a cartridge ready to fire a bullet. A magazine (not shown) may hold multiple cartridges and feed the cartridges by a follower and spring into the breech and then the chamber responsive to movement of the breech-slide 30. A magazine receiver (not shown) may be located within the grip 24 of the pistol for removably holding the magazine, and a movable and cockable hammer 32 is provided for striking a firing pin (not shown) which in-turn can strike the primer of a cartridge within the chamber. A mainspring (not shown) biases the hammer 32 toward the firing pin, and a spring biased sear (not shown) releasably holds the hammer 32 in a cocked position and is pivotally mounted to be moved by pressure against a trigger 34 to release the spring loaded cocked hammer 32 so the hammer 32 strikes the firing pin. The trigger 34 is depressible by a shooter's finger to manipulate the sear and release the hammer 32 to cause the firing of a cartridge. A trigger guard 36 may be mounted to the frame 22 and surround the trigger 34 for safety purposes. An extractor and an ejector system (not shown) is used for ejecting a spent shell or casing from the open breech, and a reaction or recoil spring (not shown) may be provided for returning the breech-slide 30 to a forward and breech-closed position such as after the pistol has been fired and the casing ejected and a cartridge moved into the chamber from the magazine. A grip safety may be provided which normally locks the trigger or otherwise prevents discharge of a cartridge until the grip safety is manually depressed with proper grasping of the grip panels of the pistol.

The pistol 10 is fired by reciprocating motion of the trigger 34. For example, the shooter's finger moves the trigger 34 inward toward the grip and the internal movable parts (sear, sear spring, etc.) of the pistol move the trigger 34 back outward into the ready position. The pistol may be fired as rapidly as the shooter can squeeze and let-up on the trigger 34 until such time as all of the cartridges have been fired. The breech-slide 30 locks into the rearward breech open position following the last cartridge being fired and the casing thereof ejected from the pistol, thereby providing a clear indication to the user that the pistol is out of ammunition.

As discussed above, the pistol 10 also includes a thumb lever safety 12 as above described for locking the trigger 34, the hammer 32 (i.e., cartridge firing components), and the breech-slide 30 when pivoted into the on-safe position (up toward the breech-slide 30 as shown in FIGS. 1 and 2), and for releasing the trigger 34, hammer 32 and breech-slide 30 to allow them to move upon pressure applied to the trigger 30 for causing firing of the pistol, if the grip safety is properly depressed as described above. The pistol 10 may also include an outwardly biased knob 38, biased by a spring within a tube. The knob is biased outward to press against the side edge of the thumb lever safety 12 so that the safety 12 resides in one or the other of two spaced positions or recesses in the thumb lever primarily to aid in retaining the thumb safety lever either in the on safe or off safe positions. The pistol includes additional other components which are well known to those skilled in the art and which will not be herein detailed or detailed to any extent.

Figure 4:
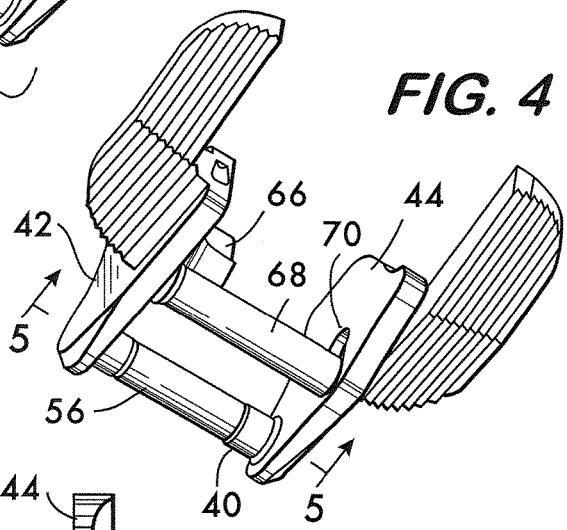
FIG. 4 is a perspective view of the ambidextrous safety of FIG. 3 in an assembled condition in accordance to an embodiment.
Figure 5:
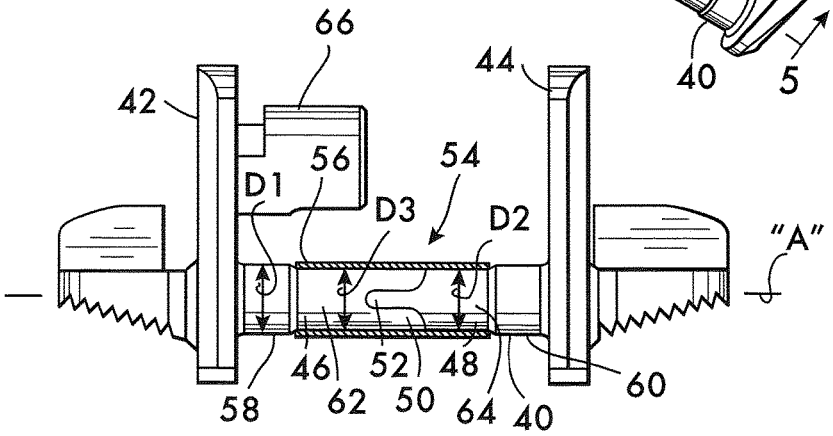
FIG. 5 is a cross-sectional view of the ambidextrous safety taken along plane 5-5 of FIG. 4 in accordance to an embodiment.

According to an embodiment, the ambidextrous safety 12 shown in FIGS. 3-5 includes the right-thumb lever safety 14 interconnected by a shaft, or safety pivot pin, 40 to the left-thumb lever safety 16. The shaft 40 extends through apertures formed in the frame 22 of the firearm 10 and connects the opposed safeties, 14 and 16, to the frame of the firearm 10 in a manner permitting the right and lever thumb lever safeties, 14 and 16, to pivot about an axis "A" extending longitudinally through the shaft 40.

Each of the safeties, 14 and 16, include a lever portion (which is intended to be engaged by a thumb of the shooter) and a plate, 42 and 44 respectively, from which the lever portion extends. In addition, interlocking shaft portions, 46 and 48, extend from the plates, 42 and 44, respectively on an opposite side of the plates, 42 and 44, relative to the lever portions. See FIG. 3-5. Together, the interlocking shaft portions, 46 and 48, form the shaft 40. According to an embodiment, each shaft portion, 46 and 48, forms approximately half of the full length of the shaft 40. In other embodiments, the shaft portions, 46 and 48, may be of different lengths.

As best illustrated in FIGS. 3 and 5, the free end of the shaft portion 46 includes a fork 50 defining an open groove and the free end of the shaft portion 48 includes a tongue 52. These end structures enable interconnection of the interlocking shaft portions, 46 and 48, in a tongue-and-groove manner ensuring that both the right and left thumb lever safeties pivot together about axis "A". See FIG. 5. Thus, when one is pivoted into a predetermined position (on-safe or off-safe), the other pivots into the same position.

As best shown in FIGS. 3 and 5, the interlocking shaft portions, 46 and 48, are essentially of the same length; thus, the tongue and groove connection 54 is located centrally or approximately midway between the opposite right and left thumb lever safeties. Accordingly, the connection 54 is located at a central location along the shaft 40. Alternatively, the connection 54 may be offset to one of the right-thumb lever safety 14 or the left-thumb lever safety 16.

For purposes of reinforcing connection 54 and to prevent the fork 50 of the shaft 46 from spreading, a separate sleeve 56 is slid onto the shaft 40 during assembly such that the sleeve 56 directly and closely surrounds and supports the interlocking shaft portions 46 and 48 and extends directly about the tongue-and-groove connection 54. Little to no play should be enabled between the shaft 40 and sleeve 56.

As best shown in FIG. 5, each of the shaft portions, 46 and 48, includes a base segment, 58 and 60, of a first pre-determined diameter "D1" located adjacent the plate, 42 and 44. Each base segment, 58 and 60, extends within an aperture formed in the frame 22 of the firearm 10 and is engaged by the walls of the frame 22. The free end segments, 62 and 64, of the interlocking shaft portions, 46 and 48, are each of a second pre-determined diameter "D2" that is less than the first pre-determined diameter "D1" of the base segments, 58 and 60. Thus, the free end segments, 62 and 64, of the shaft portions, 46 and 48, provide a recess relative to and between the base segments, 58 and 50, for providing a seat for the sleeve 56 between the base segments, 58 and 60, such that the ends of the sleeve 56 abut against the base segments, 58 and 60. This arrangement captures the sleeve 56 in place on the shaft 40 and prevents any movement of the sleeve 56 in a longitudinal direction on the shaft 40. Thus, in the condition shown in FIG. 5, the sleeve 56 is prevented from any movement relative to the shaft 40.

The inner diameter "D3" of the sleeve 56 is sufficiently large to accommodate the diameter "D1" of the free end segments of the interlocking shaft portions but otherwise closely abuts against the outer diameter of the free end segments of the interlocking shaft portions such that no play or movement of the sleeve 56 can occur relative to the free end segments, 62 and 64. In addition, preferably the inner diameter "D3" of the sleeve 56 is less than the diameter "D1" of the base segments, 58 and 60, of the shaft portions so that the sleeve 56 abuts against the base segments, 58 and 60, and may not extend over the base segments, 58 and 60. In this manner, the sleeve 56 keeps the connection 54 tightly together, constricts and prevents any spreading of the fork 50, ensures smooth operation of the safety 12, and prevents any loosening or failure thereof.

In addition to the above components, the ambidextrous safety 12 may include a locking stud 66. The locking stud 66 may extend inward from the plate 42 of the right-thumb lever safety 14 in a position to engage the hammer and sear as discussed above for preventing movement of the trigger and hammer when the safety is positioned in the "on-safe" position, for instance, as shown in FIGS. 1 and 2.

In addition, the ambidextrous safety may include a hammer pin 68 that interconnects with the plate 44 via a slotted aperture 70 formed in the plate 44. See FIGS. 3 and 4. The hammer pin 68 includes a groove 72 that permits the hammer pin 68 to be inserted into and slid within the aperture 70 such that it may be removably captured to the plate 44. When assembled, the hammer pin 68 extends to the opposite plate 42, but is not mechanically connected thereto. All the above referenced components may be made of metal or like material.

The foregoing description and specific embodiments are merely illustrative of the principles thereof, and various modifications and additions may be made to the apparatus by those skilled in the art, without departing from the spirit and scope of this invention.

The invention claimed is:

1. An ambidextrous safety for a firearm, comprising separate first and second opposed and spaced-apart thumb safeties, said thumb safeties being interconnected by a shaft extending therebetween, said shaft comprising a first shaft portion extending from said first thumb safety and a second shaft portion extending from said second thumb safety, said first shaft portion being interlocked with said second shaft portion, said shaft extending through a separate sleeve which surrounds and reinforces a location on said shaft where said first and second shaft portions are interlocked, wherein said location on said shaft where said first and second portions are interlocked is a central location along a length of said shaft between said first and second opposed and spaced-apart thumb safeties.

2. An ambidextrous safety for a firearm, comprising separate first and second opposed and spaced-apart thumb safeties, said thumb safeties being interconnected by a shaft extending therebetween, said shaft comprising a first shaft portion extending from said first thumb safety and a second shaft portion extending from said second thumb safety, said first shaft portion being interlocked with said second shaft portion, said shaft extending through a separate sleeve which surrounds and reinforces a location on said shaft where said first and second shaft portions are interlocked, wherein each of said first and second shaft portions includes an end segment, wherein said end segment of one of said first and second shaft portions includes a tongue and said end segment of the other of said first and second shaft portions includes a fork forming a groove, wherein said tongue and fork of said end segments form a tongue and groove connection that interlocks said first shaft portion to said second shaft portion, wherein each of said first and second shaft portions includes a base segment extending between said thumb safety and said end segment, wherein each of said base segments is of a first pre-determined diameter and each of said end segments is of a second pre-determined diameter, and wherein said first pre-determined diameter is greater than said second pre-determined diameter.

3. The ambidextrous safety according to claim 2, wherein said location on said shaft where said first and second portions are interlocked is offset from a central location along a length of said shaft between said first and second opposed and spaced-apart thumb safeties.

4. The ambidextrous safety according to claim 2, wherein said tongue and groove connection is located centrally on said shaft and is equally spaced from each of said first and second thumb safeties.

5. The ambidextrous safety according to claim 2, wherein said sleeve has an inner diameter that is less than said first pre-determined diameter and is able to slide over and accommodate said second pre-determined diameter in a manner constricting any spreading of said fork.

6. The ambidextrous safety according to claim 5, wherein said sleeve extends over a full length of said shaft formed by said end segments of said first and second shaft portions and is captured on said shaft and prevented from movement along a longitudinal direction on said shaft by and between said base segments of said first and second shaft portions.

7. The ambidextrous safety according to claim 6, wherein said first thumb safety includes a first thumb lever extending from a first side of a first base plate, wherein said first shaft portion extends from an opposite side of said first base plate, wherein said second thumb safety includes a second thumb lever extending from a first side of a second base plate, and wherein said second shaft portion extends from an opposite side of said second base plate.

8. The ambidextrous safety according to claim 7, wherein each of said base segments of said first and second shaft portions extend from said first and second base plates, respectively.

9. The ambidextrous safety according to claim 8, wherein a locking stud extends from one of said first and second base plates.

10. The ambidextrous safety according to claim 8, wherein a separate hammer pin is removably connected to one of said first and second base plates via a slotted aperture formed in said one of said first and second base plates.

11. The ambidextrous safety according to claim 10, wherein said one of said first and second base plate to which said hammer pin is connected is opposite to said one of said first and second base plate base plate to which said locking stud extends.

12. A firearm having an ambidextrous safety, comprising:

a firearm frame having a left side, a right side, a handle portion, and aligned apertures extending through said left and right sides;

a first thumb safety located on an exterior of said left side of said firearm frame;

a second thumb safety located on an exterior of said right side of said firearm frame;

a shaft extending through said apertures in said firearm frame and interconnecting said first and second thumb safeties in a manner permitting said first and second thumb safeties to pivot between first and second positions relative to said frame, said shaft comprising a first shaft portion extending from said first thumb safety and a second shaft portion extending from said second thumb safety, said first and second shaft portions being interlocked by a tongue and groove connection; and a separate sleeve through which said shaft extends, said sleeve surrounding and reinforces said tongue and groove connection to prevent loosening or disconnection thereof;

wherein each of said first and second shaft portions includes an end segment, wherein said end segment of one of said first and second shaft portions includes a tongue and said end segment of the other of said first and second shaft portions includes a fork forming a groove, wherein said tongue and fork of said end segments form said tongue and groove connection that interlocks said first and second shaft portions; and wherein each of said first and second shaft portions includes a base segment extending between said thumb safety and said end segment, wherein each of said base segments is of a first pre-determined diameter and each of said end segments of a second pre-determined diameter, wherein said first pre-determined diameter is greater than said second pre-determined diameter, and wherein said sleeve has an inner diameter that is less than said first pre-determined diameter and is able to slide over and accommodate said second pre-determined diameter in a manner constricting and spreading of said fork.

13. The firearm according to claim 12, wherein said sleeve extends over a full length of said shaft formed by said end segments of said first and second shaft portions and is captured on said shaft and prevented from movement along a longitudinal direction on said shaft by and between said base segments of said first and second shaft portions.

14. The firearm according to claim 12, wherein said first thumb safety includes a thumb lever extending from a first side of a first base plate, wherein said first shaft portion extends from an opposite side of said first base plate, wherein said base segment of said first shaft portion extends from said first base plate, wherein said second thumb safety includes a thumb lever extending from a first side of a second base plate, wherein said second shaft portion extends from an opposite side of said second base plate, and wherein said base segment of said second shaft portion extends from said second base plate.

15. The firearm according to claim 14, further comprising a trigger and hammer connected to said firearm frame, and wherein a locking stud extends from one of said first and second base plates to lock the trigger and hammer and prevent firing of the firearm when the ambidextrous safety is positioned in a safe position.

16. The firearm according to claim 15, wherein a hammer pin is connected to one of said first and second base plates via a slotted aperture formed in said one of said first and second base plates, and wherein said one of said first and second base plates to which said hammer pin is connected is opposite to the other one of said first and second said base plates to which said locking stud extends.

* * * * *